United States Patent [19]

Lombardi

[11] 4,340,992

[45] Jul. 27, 1982

[54] HINGE CATCH

[76] Inventor: Adolfo Lombardi, 288 Cunningham Ave., Ottawa, Canada, K1H 6B4

[21] Appl. No.: 158,279

[22] Filed: Jun. 10, 1980

[30] Foreign Application Priority Data

Oct. 19, 1979 [CA] Canada .....338040

[51] Int. Cl.[3] ..... E05D 11/06

[52] U.S. Cl. ..... 16/349

[58] Field of Search ..... 16/169, 144, 137, 349, 16/353

[56] References Cited

U.S. PATENT DOCUMENTS

| | | | |
|---|---|---|---|
| 2,431,263 | 11/1947 | Lundgren | 16/144 |
| 3,874,029 | 4/1975 | McCullough | 16/144 |
| 3,969,788 | 7/1976 | McCullough | 16/144 |

FOREIGN PATENT DOCUMENTS

| | | | |
|---|---|---|---|
| 1079913 | 6/1980 | Canada | 16/144 |
| 1513376 | 6/1978 | United Kingdom | 16/144 |

*Primary Examiner*—Werner H. Schroeder
*Assistant Examiner*—Andrew M. Falik

[57] ABSTRACT

A lockable door hinge is described which is of the usual butt hinge type with a pair of pivoting butt plates. One of these plates contains a vertically slidable bolt which moves into and out of engagement with at least one projecting abutment flange on the other butt plate. By vertical positioning of the bolt, the door may swing freely or it may be limited in its swinging movement to a closed position or one or more partially open positions. The bolt may also be used to hold the door in an open position.

12 Claims, 9 Drawing Figures

FIG. 3
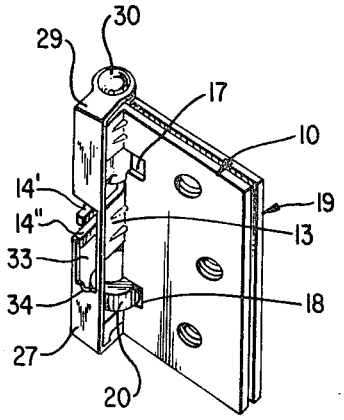
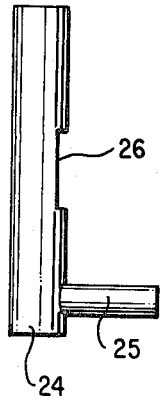
FIG. 4
FIG. 5
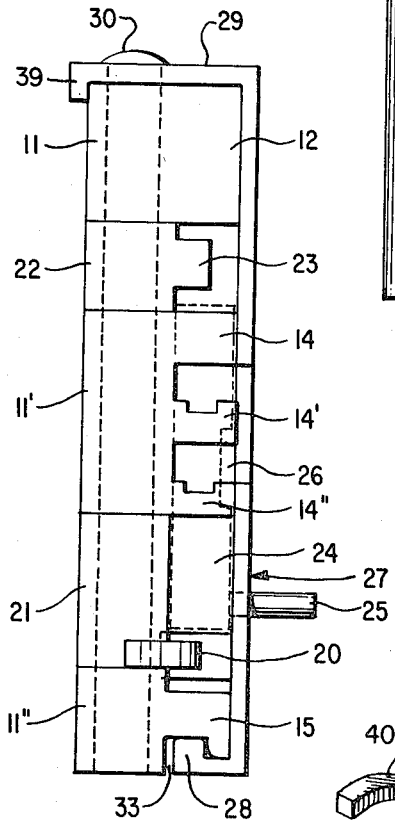
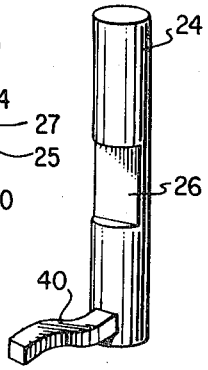
FIG. 4a.

HINGE CATCH

BACKGROUND OF THE INVENTION

1. Field of the Invention

This invention relates to hinges for doors or windows and more particularly to lockable butt hinges for household doors.

2. Summary of the Prior Art

Lockable hinges have been known for a long time and are described as far back as 1889 in Canadian Pat. No. 31895. Such lockable hinges have usually been considered in relation to shutters and the like and have been concerned primarily with an arrangement whereby the shutter or door is in a fully closed or fully open position.

With the usual household front entry door, in terms of personal safety there is a practice of providing a short safety chain so that a person inside the house may open the door a short distance with the chain attached to see who is outside. The short chain is intended to prevent access by an undesirable person after the door has been partially opened.

In terms of allowing for ventilation of a household, it may also be desirable to have a front door open to different degrees of opening anywhere between being open only a slight crack to being fully open.

It is, therefore, the general object of the present invention to provide a lockable butt hinge arrangement for a door which will permit opening of the door to selected degrees of opening but no further.

SUMMARY OF THE INVENTION

This invention relates to a hinge assembly including a first butt plate for mounting on a door jamb and a second butt plate for mounting on the edge face of a door. One of the butt plates includes along one side edge thereof at least three axially spaced gudgeons (or round cylindrical sockets) for receiving a pintle (or pivot pin). Pairs of diametrically spaced rigid flanges project outwardly from these gudgeons with one flange of one of the pairs of flanges containing at least two horizontal slots. The second butt plate includes along one side edge thereof at least two axially spaced gudgeons adapted to fit between the first butt plate gudgeons and receive a common pintle, one of these second butt plate gudgeons including at least one radially projecting rigid abutment flange. A pintle is adapted to pass through the gudgeons of both plates to hold the plates in pivotal relationship. A slide bolt is adapted to slide within a vertical gap formed between the first butt plate rigid flanges and to move into engagement with the second butt plate rigid abutment flange to thereby either hold the door shut or limit the opening of the door or move out of engagement with the abutment flange to permit free opening of the door. This slide bolt includes a radial pin projecting outwardly therefrom for manipulating the bolt. A cover plate is also provided to cover the vertical gap containing the slideable bolt.

Preferably, when the slide bolt is in its lowermost position, it is totally out of engagement with the rigid flange so that the door is freely swingable. Then in intermediate and upper positions the slide bolt is adapted to engage the rigid flange thereby either preventing any swing or restricting the degree of swing of the door. There may be several of these intermediate or upper positions with recesses of different depths in the bolt for the different locations whereby the rigid flange and hence the door can swing through larger or smaller arcs before engaging the bolt.

The bolt can be fixed in the different positions by providing slots within which the projecting bolt pin rests. For instance, the horizontal slots in one of the pairs of gudgeon flanges of the first butt plate can serve as such slide bolt pin holders.

The hinges of this invention should be made from a metal which is not easily deformable and the projecting flanges may also include stiffening ribs so as to prevent damage to the hinges if someone should try to force the door when the slide bolt is in engagement with the rigid abutment flange.

The slide bolt itself is typically of cylindrical configuration with recesses cut into the slide to provide the different abutment points with the rigid abutment flange.

The vertical gap which holds the slide bolt is covered by a cover plate which serves to prevent tampering with the slide bolt and also retains it in position. The cover plate may include a slot therein within which the projecting pin of the slide bolt moves. The bolt may also be rotated by lateral movement of the pin within the slot and the pin may come to rest at the lower extremity of the slot when the slide bolt is in its lowermost position.

According to a preferred embodiment of the invention, the second butt plate includes on a gudgeon thereof a pair of spaced radially projecting rigid abutment flanges. These may conveniently be angularly spaced by about 90°. With the pair of abutment flanges, one flange serves the purpose of holding the door closed as described above while the second flange is used to hold the door in an open position. Thus, when the door is in an open position the second flange is positioned such that it will engage the slide bolt when moved to an upper position and thereby hold the door open.

According to a particularly preferred embodiment of the invention, the second butt plate may include on one of its gudgeons an annular projection with tapering top and bottom faces designed to engage a corresponding slot in the first butt plate. This provides a convenient means for aligning the gudgeons of the two butt plates when they are being assembled.

According to yet another particularly preferred embodiment of the invention, the pintle itself can be specially designed for ease of installation. Thus, the pintle may firstly be tapered at its lower extremity for ease of movement through the gudgeons and, furthermore, the pintle can be arranged so that it can rest in position in the uppermost gudgeon without interference while the hinge is being assembled. This is achieved by providing a slot along the length of the pintle and a projecting tab within a hole in the top cover plate of the hinge whereby the pintle moves upwardly and downwardly with the tab travelling within the groove. At a convenient location close to the lower end of the pintle is provided a lateral slot extending from the vertical slot whereby the pintle may be rotated such that the top tab rests in this lateral slot. This is arranged such that when the tab engages the lateral slot, the lowermost tip of the pintle is entirely within the uppermost gudgeon so that it will not interfere with the assembly of the hinge. Then, when the butt plates are in alignment, the pintle can be rotated slightly so that the tab is in alignment with the vertical slot and the pin will then drop down through the hinge to secure the plates together. This serves to greatly simplify the installation of a door.

SUMMARY OF THE DRAWINGS

FIG. 3 is a perspective view of the fully assembled hinge and showing the cover plate in position;

FIG. 4 is an elevation showing details of the slide bolt;

FIG. 4*a* is a perspective view of a further embodiment of the slide bolt;

FIG. 5 is an end elevation of a fully assembled hinge according to the invention;

As illustrated in FIG. 1, the butt plate 10 is mounted on a door jamb by means of screws. This hinge plate includes an upper gudgeon 11, an intermediate gudgeon 11' and a lowermost gudgeon 11''.

Figure 1:
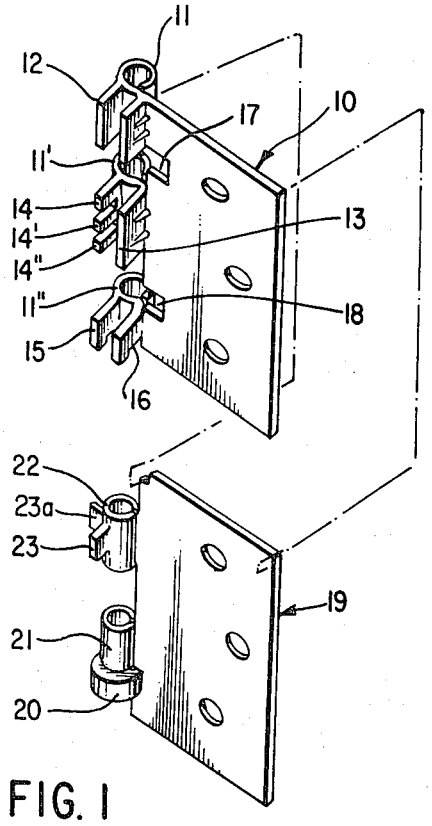
FIG. 1 is a perspective view showing both butt plates unassembled.

Projecting outwardly from the topmost gudgeon 11 are a pair of spaced flange members 12. The intermediate gudgeon 11' has extending outwardly therefrom a pair of flanges 13 and 14 with the flange 14 being divided into three sections, 14, 14' and 14'' with horizontal slots therebetween. The lowermost gudgeon 11'' again has a pair of flanges 15 extending outwardly therefrom, these lowermost flanges having slots 16 in the lowermost faces thereof. There are axial gaps between the gudgeons 11, 11' and 11'' and slots 17 and 18 are cut into plate 10 as extensions of the gaps between the gudgeons.

The second butt plate 19 is adapted to be mounted on a door and this plate has along one edge thereof a pair of axially spaced gudgeons 21 and 22. These gudgeons 21 and 22 are designed to fit snugly within the gaps formed between the gudgeons 11, 11' and 11'' of the first butt plate. The upper gudgeon 22 has a pair of rigid flanges or abutments 23 and 23*a* which, in assembled location, are designed to swing freely within the gap between gudgeon 11 and gudgeon 11'. The flanges 23 and 23*a* are radially spaced by about 90° and the purposes of these flanges will be described in greater detail hereinafter. The gudgeon 21 includes at the lowermost edge thereof an annular flange 20 with a tapered face. This flange fits within gap 18 of plate 10 and, because of the tapered faces, provides an easy means for aligning the hinges during assembly.

Mounted within the vertical gaps formed between the flanges 12, 14 and 15 is a slidable bolt 24. This bolt may be of cylindrical configuration and includes a projecting pin 25 for manipulation. The bolt includes an intermediate recess 26 and one or more of these of different depths may be utilized. The slide bolt 24 is held in position by means of a cover plate 27 which covers the outer edge of the gaps between the projecting flanges of plate 10 as well as the edge faces of these flanges. In order to hold this plate in position, it includes a bottom lip 28 which is received and held by slot 16 of flanges 15. The upper end 29 of the cover plate extends over the top of the hinge and is held in place by means of a lip 39 which hooks over gudgeon 11.

Figure 6:
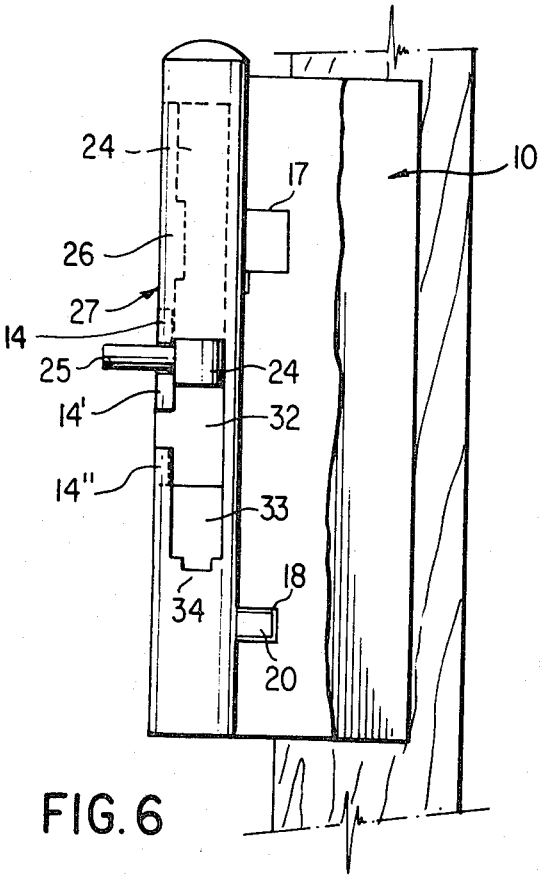
FIG. 6 is a side elevation of a fully assembled hinge.
Figure 7:
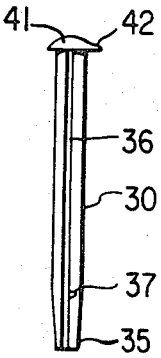
FIG. 7 is a side elevation of a preferred form of pintle.
Figure 8:
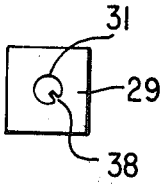
FIG. 8 is a plan view of the hole for the pintle of FIG. 7.

As will be seen from FIG. 6, the cover plate 27 includes a slot 32 including a downwardly projecting portion 33 and a lower extremity 34. In operation, the pin 25 of the slide bolt 24 projects from the slot 32 and can rest in one of three positions, the first position is in the lower extremity 34 of slot 32, the second position is resting on gudgeon portion 14'' and the third position is resting on gudgeon portion 14'.

It will, therefore, be seen that when pin 25 is resting on lower extremity 34, the uppermost end of bolt 24 is at a vertical position below the rigid flanges 23 and 23*a*. Accordingly, the flanges 23 and 23*a* are free to swing with the door through any desired arc. When the bolt 24 is moved to the second position with pin 25 resting on gudgeon portion 14'', the uppermost portion of the bolt 24 has assumed a position adjacent the flange 23. The bolt in this position is in fact in very close proximity to the flange 23 so that the door cannot be opened. By moving the bolt 24 upwardly to the third position, the recess 26 is directly adjacent the flange 23 and, because of the recess 26, the flange 23 is given greater freedom of movement so that the door can be opened in this position to a somewhat greater degree than in the second position. In this position the door can be opened only a rather small crack sufficient for a person on the inside to peer through and see who is outside the door.

Figure 2:
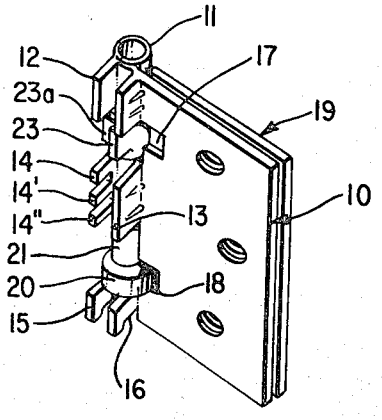
FIG. 2 is a perspective view of the butt plates in assembled position.

The second rigid flange 23*a* represents a particularly preferred embodiment of the invention and may be used together with the slide bolt of FIG. 4 or 4*a* as a means for holding the door in an open position. Thus, it will be seen from FIGS. 1 and 2 that as the door is swung open, the hinge plate 19 swings with respect to hinge plate 10 so that the flange 23*a* moves radially through the gap within which the bolt 24 moves. When the door is fully open, the bolt 24 is moved upwardly so that it engages the flange 23*a* and prevents the door from closing.

In order to hold the door open in a fixed position without free movement beyond the engagement with flange 23*a*, a usual wall or floor mounted door stop may be used. However, this may also be accomplished by means of the special slide bolt of FIG. 4*a*, which has a curving pin 40 of rectalinear cross-section. Thus, when the door is locked in open position by slide bolt 24, the curved portion of pin 40 acts as an abutment preventing further opening of the door. In this manner the door is securely held in an open position.

The pintle 30 includes a tapered lower end 35 and a slot 36 extending the length thereof. Also, at a lower section of the pintle there is provided a small lateral slot 37 interconnecting with the vertical slot. The pintle travels through the hole 31 in the top 29 of cover plate 27, with a projecting tab 38 of the hole 31 moving within the vertical slot.

When a door is being mounted, the pintle 30 is simply placed in the hole at the top, then lowered down until the lateral groove 37 comes into engagement with the tab 38 so that the pintle rests in this position. Then, when the door has been positioned in the doorway and the gudgeons of the two hinge plates are in alignment, the pintle is simply rotated until the tab comes into alignment with the vertical groove and the pintle then drops down through the gudgeons, securing the door in operational position.

The tab 38 is mounted in the top 29 for ease of manufacture. However, this tab may also be formed as a projection on the inner cylindrical wall of upper gudgeon 11.

The pintle 30 may also have a head 41 with a projecting tab 42 for ease of moving the pintle.

While presently preferred embodiments of the apparatus of the present invention have been described herein, with reference to the accompanying drawings, it is understood that variations, modifications, omissions, and refinements which depart from the disclosed embodiments may be adopted without departing from the spirit and scope of this invention.

I claim:

1. A lockable butt hinge comprising:

(a) a first butt plate including along one side edge thereof at least three axially spaced gudgeons for receiving a pintle, pairs of diametrically spaced axially extending rigid flanges projecting outwardly from said gudgeons with one flange of one of said pairs of flanges containing at least two horizontal slots, (b) a second butt plate including along one side edge thereof at least two axially spaced gudgeons adapted to fit between the first butt plate gudgeons and receive a common pintle, one of said gudgeons including a radially projecting axially extending rigid abutment flange, (c) a pintle adapted to pass through said gudgeons to hold said first and second butt plates in pivotal relationship, (d) a slide bolt adapted to slide within a vertical gap formed between said first butt plate rigid flanges and to move into engagement with said second butt plate rigid abutment flange to thereby limit the opening of the door or move out of engagement with the abutment flange to permit free opening of the door, said slide bolt including a radial pin projecting outwardly therefrom for manipulating the bolt and (e) a cover plate adapted to cover the vertical gap containing the bolt.

2. The hinge assembly according to claim 1 wherein the cover plate includes a slot within which said bolt pin moves.

3. The hinge assembly according to claim 2 wherein said slot pin is adapted to rest in any one of three positions, namely (1) at the bottom of said cover plate slot or (2) in one of the first butt plate horizontal slots or (3) in the other of the first butt plate horizontal slots.

4. The hinge assembly according to claim 3 wherein said bolt is cylindrical and has a recess in the cylindrical wall thereof.

5. The hinge assembly according to claim 4 wherein when the bolt pin rests on the bottom of said cover plate slot, the bolt is totally out of engagement with the rigid flange so that the door is freely swingable.

6. The hinge assembly according to claim 5 wherein when the bolt pin rests in one of said slots the full bolt engages the rigid flange and when the bolt pin rests in the other of said slots the recessed portion of the bolt engages the rigid flange.

7. The hinge assembly according to claim 1 wherein the second butt plate includes on one of its gudgeons an annular projection with a tapering top face adapted to engage and move within a corresponding slot in the first butt plate.

8. The hinge assembly according to claim 1 wherein the cover plate includes a horizontal top portion, a vertical portion and a horizontal bottom portion with said bottom portion including an upwardly projecting lip adapted to engage downwardly directed recesses in the bottom edges of the lowermost of the pairs of gudgeons of the first butt plate.

9. The hinge assembly according to claim 8 wherein the cover plate top portion includes a hole for receiving the pintle, said hole including an inwardly projecting tab which mates with a longitudinal groove in the cylindrical face of the pintle.

10. The hinge assembly according to claim 9 wherein the pintle also includes a small laterally extending slot which merges with said longitudinal slot, said small lateral slot being adapted to receive said tab, thereby holding the pintle in a suspended location only within the uppermost gudgeon of the first butt plate.

11. A lockable butt hinge comprising:

(a) a first butt plate including along one side edge thereof at least three axially spaced gudgeons for receiving a pintle, pairs of diametrically spaced axially extending rigid flanges projecting outwardly from said gudgeons with one flange of one of said pairs of flanges containing at least two horizontal slots, (b) a second butt plate including along one side edge thereof at least two axially spaced gudgeons adapted to fit between the first butt plate gudgeons and receive a common pintle, one of said gudgeons including a pair of spaced radially projecting axially extending rigid abutment flanges.

(c) a pintle adapted to pass through said gudgeons to hold said first and second butt plates in pivotal relationship, (d) a slide bolt adapted to slide within a vertical gap formed between said first butt plate rigid flanges and to move into engagement with a first of said second butt plate rigid abutment flanges to thereby limit the opening of the door or move out of engagement with the said first abutment flange to permit free opening of the door, and said slide bolt being further adapted to move into engagement with the second of said second butt plate rigid abutment flanges when the door is in an open position to thereby hold the door in an open position, said slide bolt including a radial pin projecting outwardly therefrom for manipulating the bolt and (e) a cover plate adapted to cover the vertical gap containing the bolt.

12. The hinge assembly according to claim 11 wherein the radial pin of the slide bolt is shaped to serve as an abutment against further opening of the door when the door is in fixed open position with the slide bolt in engagement with the second rigid abutment flange.

* * * * *